US005679628A

United States Patent [19]

Simpson et al.

[11] Patent Number: 5,679,628

[45] Date of Patent: Oct. 21, 1997

[54] MICROEMULSION CLEANER COMPOSITIONS

[75] Inventors: Ernel O. Simpson, Yardley; Jeffrey M. McFarland, Brookhaven; Michael P. Law, West Chester; Haven S. Kesling, Jr., Drexel Hill, all of Pa.

[73] Assignee: ARCO Chemical Technology, L.P., Greenville, Del.

[21] Appl. No.: 663,768

[22] Filed: Jun. 14, 1996

[51] Int. Cl.[6] ..... C10M 173/00

[52] U.S. Cl. ..... 508/583; 508/591; 510/417; 134/40

[58] Field of Search ..... 510/417; 508/583, 508/591

[56] References Cited

U.S. PATENT DOCUMENTS

| | | | |
|---|---|---|---|
| 4,704,225 | 11/1987 | Stoufer | 510/417 |
| 4,744,796 | 5/1988 | Hazbun et al. | 44/51 |
| 5,076,954 | 12/1991 | Loth et al. | 252/122 |
| 5,082,584 | 1/1992 | Loth et al. | 252/122 |
| 5,108,643 | 4/1992 | Loth et al. | 252/174.11 |
| 5,112,516 | 5/1992 | Koetzle | 252/162 |
| 5,213,624 | 5/1993 | Williams | 134/40 |
| 5,277,836 | 1/1994 | Peters | 510/417 |
| 5,393,451 | 2/1995 | Koetzle | 252/170 |
| 5,401,326 | 3/1995 | Mihelic et al. | 134/40 |
| 5,415,813 | 5/1995 | Misselyn et al. | 252/547 |
| 5,489,394 | 2/1996 | Ford et al. | 510/417 |
| 5,534,200 | 7/1996 | Erilli et al. | 510/417 |
| 5,571,459 | 11/1996 | Thomas et al. | 510/417 |
| 5,580,848 | 12/1996 | Drapier | 510/417 |
| 5,587,357 | 12/1996 | Rhinesmith | 510/417 |
| 5,602,090 | 2/1997 | Melikyan et al. | 510/417 |

*Primary Examiner*—Ellen M. McAvoy
*Attorney, Agent, or Firm*—Jonathan L. Schuchardt

[57] ABSTRACT

Microemulsion cleaner compositions are disclosed. The cleaners comprise a terpene, a secondary or tertiary $C_4$–$C_5$ alcohol, a surfactant, and water. Compared with commercial formulations, cleaners of the invention are low in water, high in hydrocarbon, and have excellent degreasing capability. The secondary or tertiary $C_4$–$C_5$ alcohol coupling solvent, compared with other alcohols, significantly reduces the amount of surfactant required to produce a stable, effective microemulsion cleaner. The compositions are particularly valuable as metal degreasers.

14 Claims, No Drawings

MICROEMULSION CLEANER COMPOSITIONS

FIELD OF THE INVENTION

The invention relates to microemulsion cleaner compositions. In particular, the invention relates to high-terpene, low-water microemulsions useful for degreaser applications.

BACKGROUND OF THE INVENTION

Microemulsion cleaners recently entered the degreaser market as a less-toxic alternative to halogenated hydrocarbons such as 1,1,1-trichloroethane. Commercial microemulsion formulations typically consist of a continuous hydrocarbon phase that contains emulsified water droplets. The hydrocarbon phase comprises a degreasing solvent (such as a terpene), a surfactant, and one or more cosolvents or coupling agents. Glycol ethers are common coupling agents. Water-soluble alcohols are also generally disclosed as cosolvents (see, e.g., U.S. Pat. No. 5,076,954). Typical commercial formulations contain about 50 wt. % water. U.S. Pat. Nos. 5,112,516 and 5,213,624 describe some typical microemulsion cleaner compositions.

A disadvantage of microemulsion cleaners that contain a large proportion of water is that only half of the cleaner is an active grease remover, so degreasing performance is often less than satisfactory. In addition, maximum grease loading is limited by the high water content. The more grease a cleaner can hold, the longer it can be used effectively.

Another problem with current microemulsion cleaners containing up to 50 wt. % water is phase separation. Used cleaners tend to separate into hydrocarbon and aqueous phases, and this creates two separate waste streams that must be isolated and treated. Preferably, only a single waste stream containing the used cleaner would result. A single waste stream containing organics is an advantage because it can often be incinerated. On the other hand, contaminated wastewater is often extremely costly to remediate.

Some microemulsion cleaners require large amounts of relatively expensive surfactants (sometimes greater than 20 wt. %) to stabilize the microemulsions. Formulations that can use surfactants more efficiently are needed.

In sum, commercial microemulsion cleaners offer toxicity advantages over prior halogenated hydrocarbon degreasers. However, current compositions, which usually contain at least about 50 wt. % of water, suffer from less-than-satisfactory degreasing performance, limited grease loading, and phase separation that generates multiple waste streams. In addition, some commercial microemulsions require high surfactant levels. Cleaners that are free of halogenated hydrocarbons, but also alleviate or overcome the problems of current microemulsion cleaners, are needed.

SUMMARY OF THE INVENTION

The invention is a microemulsion cleaner composition. The composition comprises a microemulsion of a terpene, a secondary or tertiary $C_4$–$C_5$ alcohol, a surfactant, and water. The microemulsions contain from about 20 to about 90 wt. % of the terpene, from about 5 to about 50 wt. % of the alcohol, from about 1 to about 20 wt. % of the surfactant, and from about 5 to about 40 wt. % of water.

We surprisingly found that stable, high-hydrocarbon, low-water-content microemulsion cleaner compositions having excellent degreasing capability can be successfully prepared by using a secondary or tertiary $C_4$–$C_5$ alcohol as a coupling solvent. The compositions have more hydrocarbon available for degreasing than commercial microemulsion degreasers and can handle high grease loads. At low water contents of 20 wt. % or less, used formulations stay in one phase, which overcomes the need to treat a separate aqueous waste stream. We also surprisingly found that the use of the secondary or tertiary $C_4$–$C_5$ alcohol coupling solvent significantly reduces the amount of surfactant required to produce a stable, effective microemulsion cleaners; when a primary alcohol is used instead, a much higher proportion of surfactant is needed.

DETAILED DESCRIPTION OF THE INVENTION

Microemulsion cleaner compositions of the invention comprise a terpene, a secondary or tertiary $C_4$–$C_5$ alcohol, a surfactant, and water.

Cleaners of the invention include a terpene. Suitable terpenes include terpene hydrocarbons and terpene alcohols (terpenols). Terpene hydrocarbons derive from natural sources, and often comprise a blend of compounds that may include monocyclic and acyclic mono- and sesquiterpenes. Pure terpene compounds can also be used. Suitable terpene hydrocarbons or mixtures include, for example, terpinene, terpinolene, limonenes, dipentene, 2,6-dimethyl-2,4,6-octadiene, pinenes, turpentine, and the like, and mixtures thereof. Limonenes and turpentine are preferred. Terpene alcohols, many of which also occur in nature, are similar structurally to terpene hydrocarbons, but incorporate some hydroxyl functionality. These are primary, secondary, or tertiary alcohol derivatives of acyclic, monocyclic, or bicyclic terpenes. Suitable terpene alcohols include, for example, terpineols, linalool, borneol, geraniol, and the like, and mixtures thereof. Other examples appear in U.S. Pat. No. 5,112,516, the teachings of which are incorporated herein by reference.

The amount of terpene in the microemulsion cleaner compositions of the invention is within the range of about 20 to about 90 wt. % . More preferred compositions contain from about 35 to about 65 wt. % of the terpene. The compositions differ from prior-art microemulsion cleaners in that they incorporate a relatively high proportion of the terpene. A consequence of the high terpene content is that the microemulsions have more hydrocarbon available for degreasing than commercial microemulsion degreasers and can handle high grease loads.

A key component of the microemulsion cleaner compositions of the invention is a secondary or tertiary $C_4$–$C_5$ alcohol. Suitable secondary or tertiary $C_4$–$C_5$ alcohols include, for example, tert-butyl alcohol, tert-amyl alcohol, 2-butanol, 2-pentanol, 3-methyl-2-butanol, 3-pentanol, and the like, and mixtures thereof. The secondary or tertiary $C_4$–$C_5$ alcohol is used in an amount within the range of about 5 to about 50 wt. %. A more preferred range is from about 20 to about 35 wt. %.

The alcohol functions as a cosolvent and/or cosurfactant. Alcohols are noted sporadically in the microemulsion cleaner art as possible formulation components. However, missing from the art is any teaching that secondary and tertiary $C_4$–$C_5$ alcohols offer substantial advantages for microemulsion cleaners compared with other lower alcohols.

We found that using a secondary or tertiary $C_4$–$C_5$ alcohol allows one to formulate microemulsions having relatively low water content and relatively high terpene content compared with commercial microemulsions. We also surprisingly found that the amount of surfactant (a relatively expensive component of cleaners) required in making a stable microemulsion is significantly reduced by choosing a secondary or tertiary $C_4$–$C_5$ alcohol. As the results in Table 2 amply demonstrate, the amount of surfactant required decreases 40% (from about 24–25 wt. % to 13–16 wt. %) by using a secondary or tertiary $C_4$–$C_5$ instead of a primary alcohol. This results in a substantial cost savings to formulators because they can make a stable microemulsion with good degreasing capability that uses less surfactant.

Microemulsion cleaners of the invention include one or more surfactants. Suitable surfactants are anionic and nonionic surfactants commonly known in the cleaner art. Suitable anionic surfactants include, for example, surface active or detergent compounds that include an organic hydrophobic moiety (typically having 8 to 26 carbons) and a hydrophilic moiety selected from sulfonates, sulfates, and carboxylates. Examples include alkyl benzene sulfonates, alkyl toluene sulfonates, alkyl phenol sulfonates, alkene sulfonates, hydroxyalkane sulfonates, alkane sulfonates, paraffin sulfonates, and the like, and mixtures thereof. Suitable nonionic surfactants include condensation products of an organic aliphatic or alkylaromatic hydrophobic compound and ethylene oxide. The hydrophobic compound has a carboxy, hydroxy, amido, or amino group with a free hydrogen available for reaction with ethylene oxide. The oxyethylene chain is made longer or shorter to achieve the desired hydrophobic-hydrophilic balance. Many additional examples of suitable anionic and nonionic surfactants appear in U.S. Pat. Nos. 5,108,643, 5,112,516, and 5,213,624, the teachings of which are incorporated herein by reference.

The surfactant is used in an amount within the range of about 1 to about 20 wt. %. A more preferred range is from about 5 to about 15 wt. %. Generally, it is desirable to minimize the amount of surfactant used to that needed to produce a stable microemulsion and/or a desirable level of cleaning performance because the surfactant is typically more costly than other cleaner components. The low-water microemulsion formulations of the invention, which use a secondary or tertiary $C_4$–$C_5$ alcohol cosolvent, use much less surfactant than similar formulations containing other lower alcohols (see Table 2).

The microemulsion cleaner compositions of the invention also include water. Compared with prior-art microemulsion cleaners, those of the invention have relatively low water contents. While commercial microemulsion cleaners typically have about 50 wt. % water Content, those of the invention have from about 5 to about 40 wt. %, and preferably from about 10 to about 20 wt. % water. One consequence of the low water content is that the compositions have more hydrocarbon available for degreasing than commercial microemulsion degreasers and can handle high grease loads. In addition, when the water content is 20 wt. % or less, used formulations do not phase separate. As a result, only one waste stream is generated, and the used formulation can often be incinerated. The need to treat a contaminated wastewater stream—usually a costly proposition—can be avoided.

The microemulsion cleaners of the invention are made by mixing the terpene, alcohol, water, and surfactant components in any desired manner to produce a microemulsion, which is a thermodynamically stable, optically transparent mixture. The cleaner is applied to the substrate to be cleaned by any suitable means, including spraying, brushing, dipping, or the like.

The invention includes a method for degreasing a metal surface. The method comprises applying to a metal surface a microemulsion composition of the invention. The microemulsions of the invention are especially useful for removing greasy substances from metal surfaces, but they can also be used on ceramics, many plastics, concrete, wood, and other hard surfaces. The cleaners avoid the toxicity concerns of halogenated hydrocarbon components, but offer high capacity and good degreasing performance.

The following examples merely illustrate the invention. Those skilled in the art will recognize many variations that are within the spirit of the invention and scope of the claims.

EXAMPLE A

Degreasing Performance: Test Method

Aluminum panels (1"×3") are coated on one side using a small brush with a uniform amount of Plew's lithium grease and weighed. The degreasing solution (microemulsion) to be tested (120 mL) is placed in a 150-mL beaker with a small magnetic stirring bar. The solution is then heated gently to 25° C. Nine panels are prepared and divided into three sets of three panels. The panels are immersed in the solution, one at a time, for 1,3, or 5 minutes. After cleaning, the panels are rinsed in a beaker of water, dried in a forced-air oven at 100° C., and reweighed. The weight percentage of grease removed at any given cleaning time (1,3, or 5 min.) is calculated as an average value for three panels. Results of the testing appear in Tables 1 and 2.

The examples are meant only as illustrations; the following claims define the scope of the invention.

TABLE 1

Degreasing Performance of Low-Water Microemulsions versus Commercial Microemulsions

| | Formulation (wt. %) | | | | % Lithium Grease Removal |
|---|---|---|---|---|---|
| Ex # | t-butyl alcohol | D-limonene | water | surfactant[2] | at 3 min. |
| 1 | 30.8 | 51.3 | 10.5 | 7.5 | 83 |
| 2 | 29.8 | 38.7 | 19.4 | 12.1 | 80 |
| C3 | Commercial microemulsion A[1] (50 wt. % water) | | | | 28 |
| C4 | Commercial microemulsion B[1] (50 wt. % water) | | | | 5 |

[1]Commercial microemulsions A and B contain terpenes, glycol ethers, a surfactant, and 50 wt. % of water.
[2]Surfactant = CO-630 surfactant, a product of Rhone-Poulenc Chemical Co.
C3 and C4 are comparative examples.

TABLE 2

Effect of Secondary or Tertiary Alcohol vs. Primary Alcohol on Grease Removal Power and Surfactant Requirement

| | Formulation (wt. %) | | | Wt. % surfactant[1] | % Lithium Grease Removal at | | |
|---|---|---|---|---|---|---|---|
| Ex # | alcohol (wt. %) | D-limonene | water | required | 1 min | 3 min | 5 min |
| 5 | tert-butyl alcohol (29.0) | 38.9 | 19.1 | 13.1 | 47 | 88 | 98 |
| 6 | 2-butanol (28.6) | 37.6 | 19.1 | 14.7 | 48 | 86 | 98 |
| 7 | 2-pentanol (28.8) | 37.0 | 18.7 | 16.1 | 41 | 96 | 100 |
| C8 | 1-butanol (25.7) | 33.4 | 17.0 | 23.9 | 17 | 71 | 88 |
| C9 | 1-pentanol (24.6) | 33.5 | 17.1 | 24.8 | 25 | 67 | 87 |
| C10 | isopropyl alcohol (24.9) | 34.6 | 16.5 | 24.0 | 29 | 75 | 98 |

[1]Surfactant = CO-630 surfactant, a product of Rhone-Poulenc Chemical Co. C8–C10 are comparative examples.

We claim:

1. A composition which comprises a microemulsion of:

(a) from about 20 to about 90 wt. % of a terpene;

(b) from about 5 to about 50 wt. % of a secondary or tertiary $C_4$–$C_5$ alcohol;

(c) from about 1 to about 20 wt. % of a surfactant; and (d) from about 5 to about 40 wt. % of water.

2. The composition of claim 1 wherein the alcohol is selected from the group consisting of tert-butyl alcohol, 2-butanol, and 2-pentanol.

3. The composition of claim 1 wherein the alcohol is tert-butyl alcohol.

4. The composition of claim 1 wherein the terpene is selected from the group consisting of D-limonene, turpentine, and terpenols.

5. The composition of claim 1 wherein the surfactant is selected from the group consisting of nonionic surfactants, anionic surfactants, and mixtures thereof.

6. A composition which comprises a microemulsion of:

(a) from about 35 to about 60 wt. % of a terpene;

(b) from about 20 to about 35 wt. % of a secondary or tertiary $C_4$–$C_5$ alcohol;

(c) from about 5 to about 15 wt. % of a surfactant; and (d) from about 10 to about 20 wt. % of water.

7. The composition of claim 6 wherein the alcohol is selected from the group consisting of tert-butyl alcohol, 2-butanol, and 2-pentanol.

8. The composition of claim 6 wherein the alcohol is tert-butyl alcohol.

9. The composition of claim 6 wherein the terpene is selected from the group consisting of D-limonene, turpentine, and terpenols.

10. The composition of claim 6 wherein the surfactant is selected from the group consisting of nonionic surfactants, anionic surfactants, and mixtures thereof.

11. A composition which comprises a microemulsion of:

(a) from about 35 to about 60 wt. % of a terpene selected from the group consisting of D-limonene, turpentine, and terpenols;

(b) from about 20 to about 35 wt. % of a secondary or tertiary $C_4$–$C_5$ alcohol selected from the group consisting of tert-butyl alcohol, 2-butanol, and 2-pentanol;

(c) from about 5 to about 15 wt. % of a surfactant; and (d) from about 10 to about 20 wt. % of water.

12. A method which comprises degreasing a metal surface by applying to the surface the microemulsion composition of claim 1.

13. A method which comprises degreasing a metal surface by applying to the surface the microemulsion composition of claim 6.

14. A method which comprises degreasing a metal surface by applying to the surface the microemulsion composition of claim 11.

* * * * *